United States Patent [19]

Mekosh, Jr.

[11] 4,434,719

[45] Mar. 6, 1984

[54] STEERING MOTORIZED TRUCK

[75] Inventor: George Mekosh, Jr., Warrington, Pa.

[73] Assignee: The Budd Company, Troy, Mich.

[21] Appl. No.: 306,156

[22] Filed: Sep. 28, 1981

[51] Int. Cl.[3] ..... B61F 3/04; B61F 5/38; B61F 5/52

[52] U.S. Cl. ..... 105/168; 105/135; 105/136; 105/182 R; 105/218 R

[58] Field of Search ..... 105/135, 136, 137, 167, 105/168, 182 R, 197 B, 218 R

[56] References Cited

U.S. PATENT DOCUMENTS

| | | | |
|---|---|---|---|
| 2,908,230 | 10/1959 | Dean | 105/197 B X |
| 3,661,097 | 5/1972 | Jackson | 105/167 X |
| 3,789,770 | 2/1974 | List | 105/168 |
| 4,003,316 | 1/1977 | Monselle | 105/167 |
| 4,131,069 | 12/1978 | List | 105/182 R |
| 4,164,188 | 8/1979 | Hallam et al. | 105/135 |
| 4,221,172 | 9/1980 | Sobolewski | 105/168 |

FOREIGN PATENT DOCUMENTS

| | | | |
|---|---|---|---|
| 2034651 | 6/1980 | United Kingdom | 105/136 |

*Primary Examiner*—Robert B. Reeves
*Assistant Examiner*—Howard Beltran
*Attorney, Agent, or Firm*—Edward M. Farrell; Herman Foster; Thomas I. Davenport

[57] ABSTRACT

A steerable railway truck includes a main frame structure having a bolster and a pair of side frames to be secured to a car body. A pair of "C" shaped sub-frames are interconnected. Extending arm portions of the sub-frames are slidably mounted to the end of the side frames on shear plate assemblies. Hanger elements extend from the main frame to hold the interconnected sections of the sub-frame. A steering link member is connected between the main frame and one of the sub-frames to force the two frames to steer when the car body moves over curved tracks.

6 Claims, 11 Drawing Figures

FIG. 3
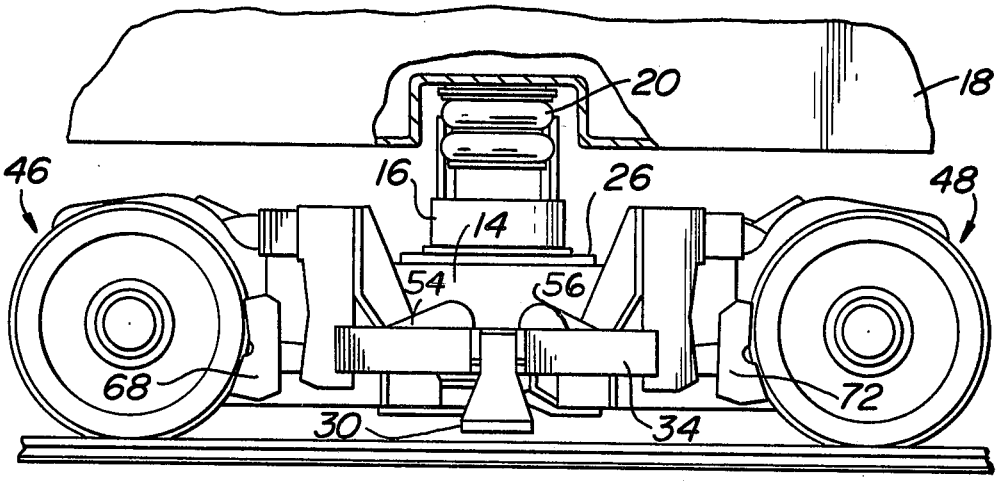
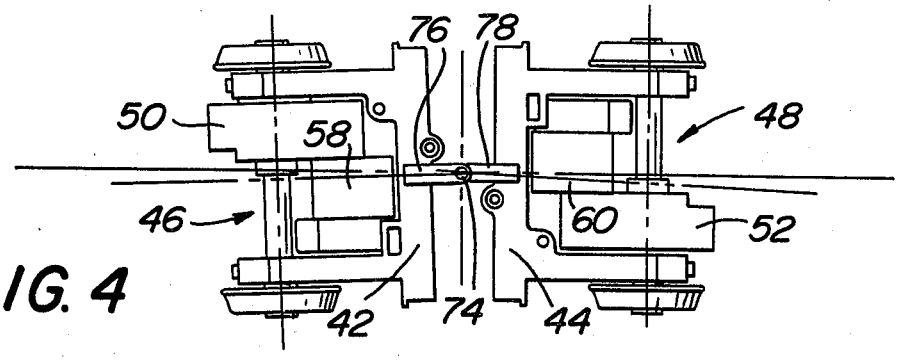
FIG. 4
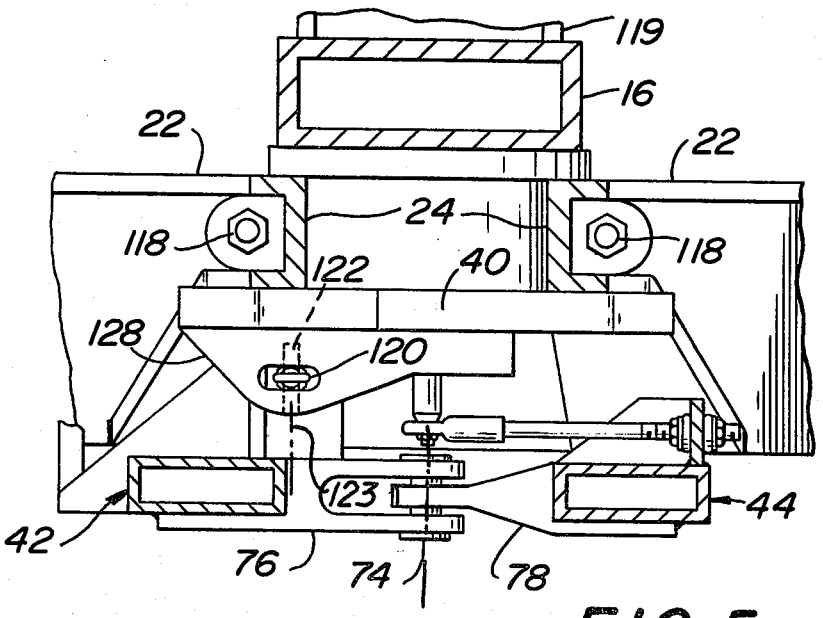
FIG. 5

FIG. 6
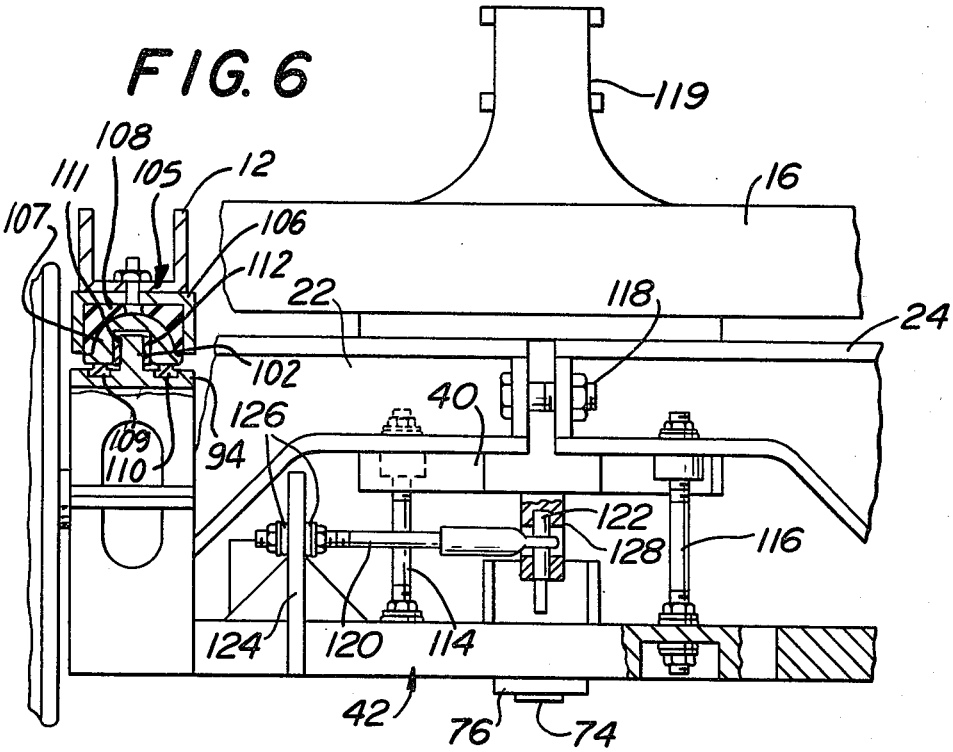
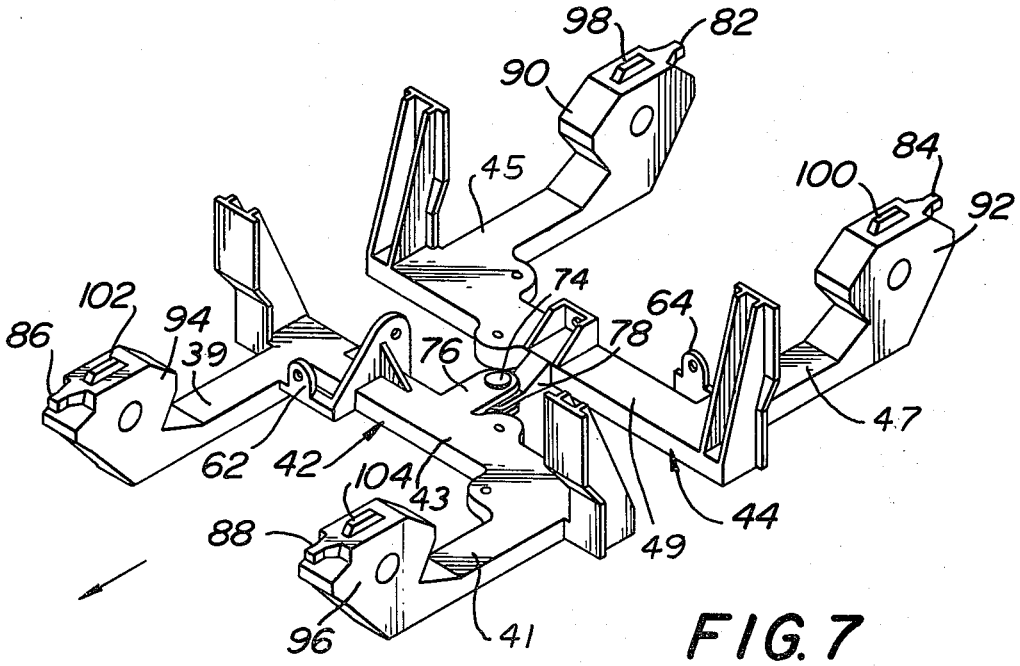
FIG. 7

STEERING MOTORIZED TRUCK

BACKGROUND OF THE INVENTION

One of the problems confronting the transit industry is the curving performance of the powered conventional urban heavy rapid rail truck. Among the curving performance problems are the high rate of wheel flange wear and rail gauge wear associated with operating heavy rapid rail cars on sharp curves. An additional problem that may be even more objectionable than the high wear rate is the high pitch screech or squeal that is associated with negotiating sharp curves (usually greater than 8 degrees curvature or approximately 700 feet radius).

The squeal noise and most of the wheel flange wear and rail gauge wear experienced with conventional parallel axle trucks are due to the non-radial running position of the leading axle in sharp curves. The non-radial running position results in a tracking error or an angle of attack between the wheel and rail. It is the associated wheel/rail angle of attack and lateral motion (creep) that cause noise, wear, and an unnecessarily high lateral force between the wheel flange and the rail. In addition, in the non-radial running position, there is a substantial rubbing velocity between the rail and the flange which causes additional noise and wear.

The noise problem can be mitigated by using resilient wheels, various other noise suppression measures, and by lubricating the wheel/rail interface. Of course, resilient wheels or noise barriers do not relieve the wear problem and lubrication must be very carefully controlled or there will be an increase in the incidence of flat wheels due to wheel slide during braking.

The addition of steering, however, cures the problem at the source by eliminating the tracking error and the associated wheel/rail lateral motion. The vibration which causes the noise is not generated. Flange forces are lower and the rubbing action is eliminated. With the need for wheel/rail lubrication removed, traction and braking performance become more consistent.

The anticipated benefits from the use of steerable trucks on urban transit vehicles are: reduced wheel flange wear, reduced rail gauge wear, reduced wheel/-rail noise, and reduced energy consumption during curve negotiation. Where cars accumulate a high percentage of their mileage on curved track, the potential dollar savings on wheel and track wear could be quite substantial.

So called steering arms have been used to steer trucks. The steering arm concept can have two modes of operation which are known as self-steering and forced (positive) steering. In the self-steering mode, the steering input comes exclusively from the self-centering action of a tapered wheelset. The steering forces are generated by the creep forces developed at the wheel/-rail contact patch. Therefore, the self-steering input is a direct function of the adhesion limits and contact geometry. In the forced-steering mode, the steering input comes from a linkage arrangement that responds to truck swivel with respect to the car body during curve negotiation. The linkage geometry positions the axles radially when the car is in a curve. Self-steering action is also present and actually aids the positive steering mode. The present invention is related to forced steering trucks.

Forced steering trucks have been used in the past. For example, patents have been issued to List U.S. Pat. Nos. 3,789,770 and 4,131,069 relating to steering trucks in railway cars.

List utilizes a steering arm at a predetermined set position dependent upon wheel base and distance between trucks to keep the wheel radial with the track. However, in some cases it may be desirable to provide oversteering or understeering. For example, by creating angles of attack between wheel flange and the track, forces are created which tend to bring the wheel flange away from the track. For example, it may be desirable to oversteer where sharp turns are involved, and understeer when high speeds are involved. Thus, it is desirable to be able to view the route of a proposed railway car to determine the overall ride conditions involving speeds and turns and then be able to design the trucks to accommodate the conditions involved, e.g., provide forced steering where the wheels of the truck move radially with the tracks or provide oversteering or understeering.

Another situation which should be recognized is that there are thousands of railway cars in existence which have little or no steering and which are likely to remain in use for many years. Because the trucks are of fixed designs to accommodate the structures of the car bodies and most generally carry many of the items, such as motors and gear boxes needed to propel the car, generally a complete redesign would normally be required to retrofit existing trucks with forced steering.

It is desirable to be able to retrofit or design forced steering trucks while at the same time utilize many of the components for driving the cars, as well as accommodating the standard designs in cars which have proven satisfactory over long periods of time. One type of railway truck involving conventional side frames, bolsters and other elements found in conventional railway cars is described in a patent to Dean U.S. Pat. No. 2,908,230.

OBJECTS OF THE INVENTION

It is an object of this invention to provide an improved steerable truck which may be readily modified to provide normal forced steering, oversteering or understeering for railway cars operating under different conditions.

It is a further object of this invention to provide an improved steerable truck capable of accommodating conventional truck bolster, wheel-axle assemblies, propulsion and tread brake units.

BRIEF SUMMARY OF THE INVENTION

In accordance with the present invention, a steerable truck for a railway car includes a main frame secured below the car body. The main frame includes a pair of side frames with a bolster connected thereto. A pair of "C" shaped sub-frames are interconnected to each other and connected to rotate about a pivot member on the main frame. Wheel assemblies and various propulsion motors and gear boxes are mounted to the sub-frames. Wheel assemblies are connected between the arms of the "C" shaped sub-frames. The ends of the arms of the sub-frames are slidably mounted within the ends of the side frames of the main frame. A steering link member is connected between the car body bolster and one of the sub-frames and may be located to provide oversteering, understeering or steering where the wheels are maintained radial to the tracks.

Other objects and advantages of the present invention will be apparent and suggest themselves to those skilled in the art, from a reading of the following specification and claims, taken in conjunction with the accompanying drawings.

BRIEF DESCRIPTION OF THE DRAWINGS

FIG. 3 is a side view of the truck illustrated in FIGS. 1 and 2 with a car body supported thereon;

FIG. 4 is a top view of the steering sub-frames not connected to the main frame of the truck illustrated in FIGS. 1, 2 and 3;

FIG. 5 is a broken-away view partly in cross-section taken from the side and towards the center of the truck;

FIG. 6 is a view broken away and partly in cross-section taken from the front and towards the center of the truck;

FIG. 7 is an isometric view of the steering sub-frames illustrated in the previous figures, in accordance with the present invention;

DETAILED DESCRIPTION OF THE PREFERRED EMBODIMENTS

Figure 1:
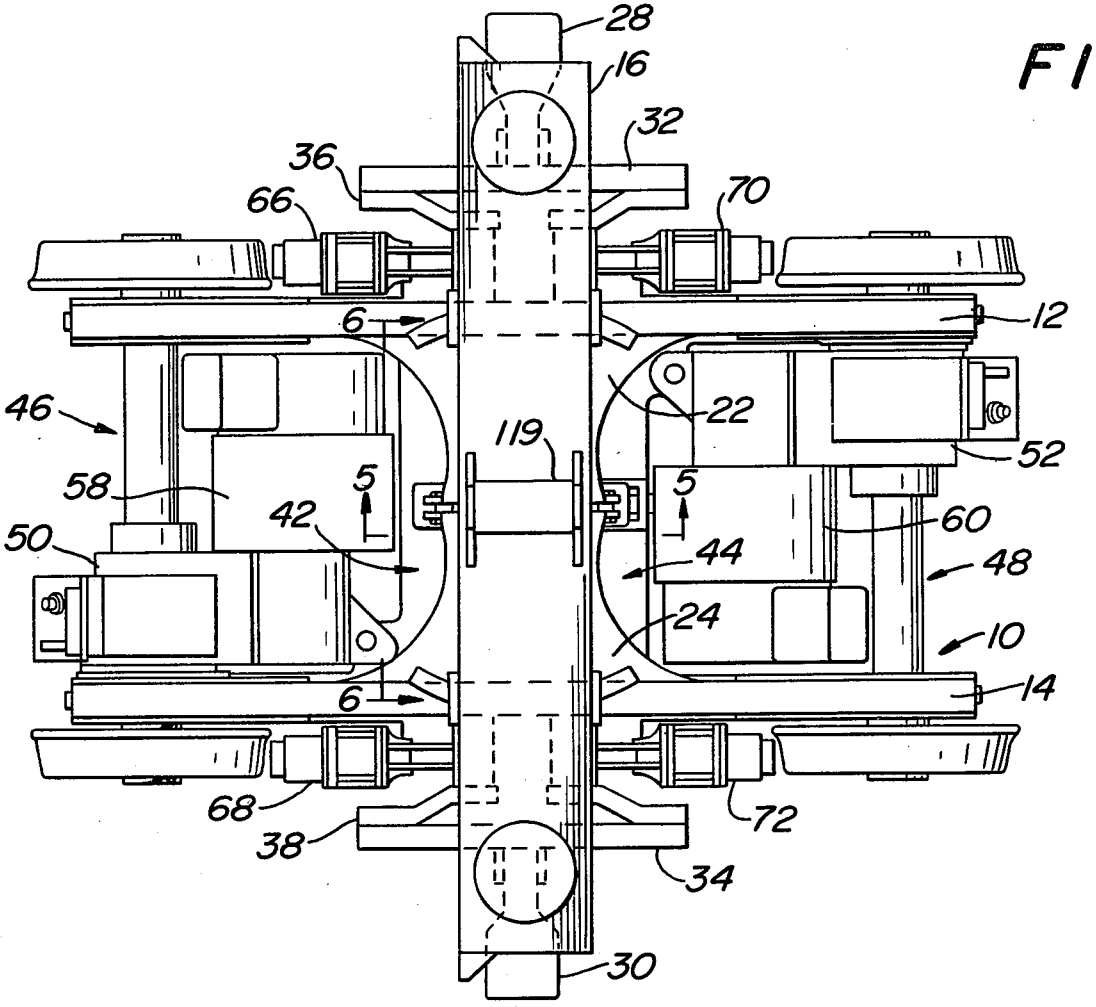
FIG. 1 is a top view of a steerable truck, in accordance with the present invention.
Figure 2:
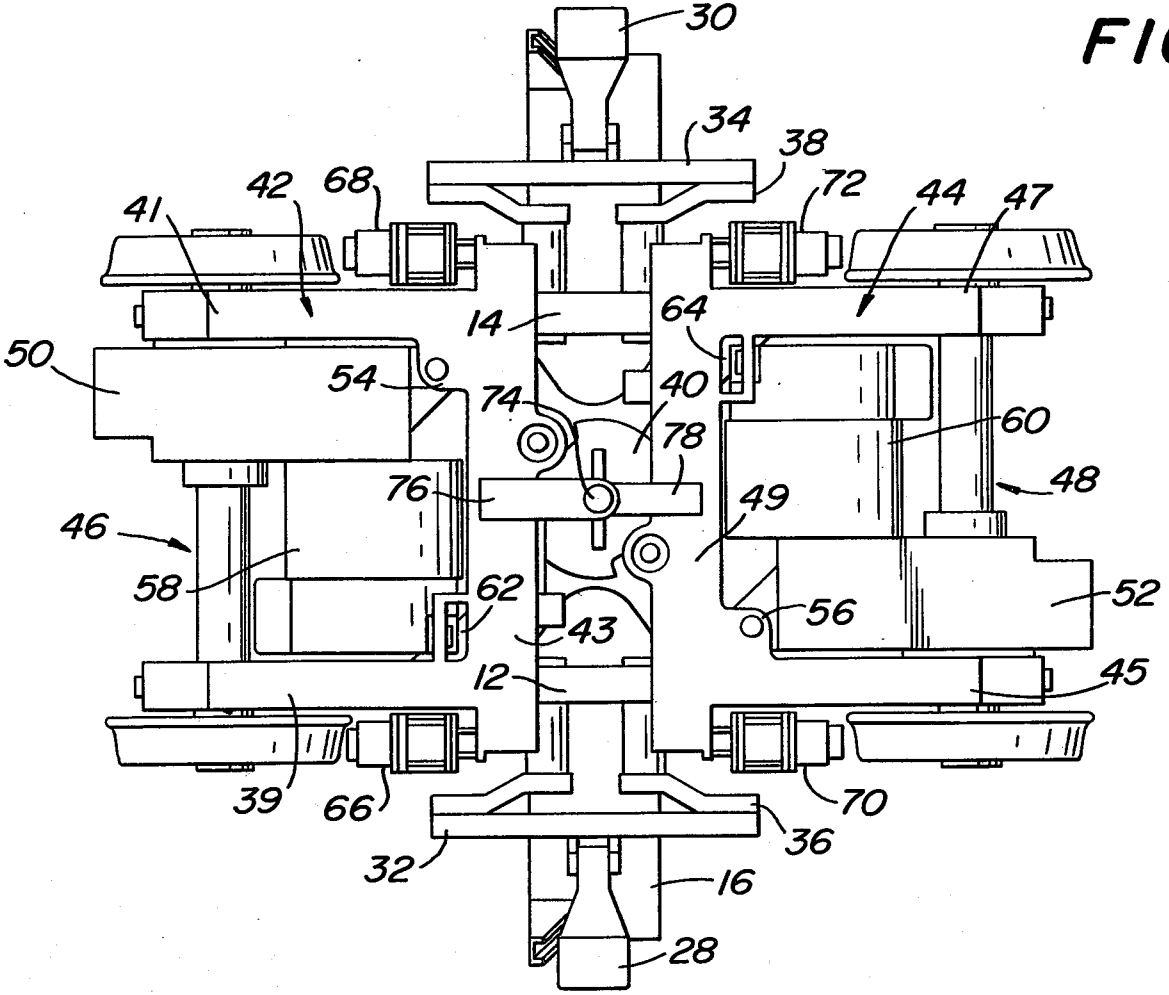
FIG. 2 is a bottom view of the truck illustrated in FIG. 1.

Referring to FIGS. 1 and 2, a main frame 10 basically comprises a pair of side frames 12 and 14 and a bolster 16. These are items found in many conventional railway trucks.

The main frame 10, as illustrated in FIG. 3, is used to support a car body 18. The car body 18 is supported on the bolster 16 by means of a pair of air springs, only one of which is illustrated in FIG. 3, this being the air spring 20. As may be more clearly seen in FIG. 1, the side frames 12 and 14 include inwardly projecting portions 22 and 24. This arrangement is sometimes referred to as a "spider" arrangement and is illustrated in the aforementioned patent to Dean.

The bolster 16 is supported on the side frames 12 and 14 through slide bearings, only one of which is illustrated in FIG. 3, i.e., the slide bearing 26. The various elements thus far described are somewhat conventional. Heretofore, the basic truck main frame 10 was designed to accommodate wheel/axle assemblies, propulsion units, and tread brake units along with various other parts. In the present invention, the various additional parts associated with the main frame have been separated therefrom to provide a forced steering arrangement, as well as providing the means for supporting the various members formerly supported by the main frame.

As illustrated in FIGS. 1 and 2, various other elements connected to the bolster 16 include third rail power collectors 28 and 30 which in turns are supported by support arms 36 and 38 which are secured by insulator blocks 32 and 34 to the side frames 12 and 14.

As illustrated in FIG. 2, a bolster center plate 40 is secured to the bolster 16. Below the main frame 10 a pair of sub-frames 42 and 44 are connected to the main frame 10 by means to be described and are used to provide the forced steering in accordance with the present invention.

In addition, the sub-frames 42 and 44 are used to support the various elements previously supported by the main frame in many conventional trucks.

The sub-frames 42 and 44 comprise steering arms and are "C" shaped structures. The sub-frames 42 and 44 receive a pair of wheel axle assemblies 46 and 48, respectively. Gear box assemblies 50 and 52 are connected to the wheel axle assemblies 46 and 48, respectively, and attached to the sub-frames 42 and 44 by conventional means at connecting points 54 and 56. Motors 58 and 60 are also connected to the "C" shaped structures 42 and 44 at lugs or support structures 62 and 64. Tread brakes 66 and 68 are secured to the sub-frame 42 and tread brakes 70 and 72 are secured to the sub-frame 44 by any conventional means, such as the mounts illustrated.

The steering arms or sub-frames 42 and 44 are connected together at the center of the truck at pivot connection or pin 74. In FIG. 2, arms 76 and 78 are connected by a pin 74, also illustrated in FIG. 7. The interconnections may be made by a Metalastic bushing. The connection between the sub-frames 42 and 44 insure equal, but opposite angular motions of the two sub-frames. This connection also transfers lateral, longitudinal, and vertical loads between the sub-frames. The steering arms or sub-frames, as mentioned, are attached to the wheel axle assembles 46 and 48 by a clamping arrangement which engages the existing shock ring around the axle journal bearing. These attachments are conventional and found in many previous trucks and therefore will not be shown or described in further detail.

The steering arm 42 may be considered as having a pair of extending arm portions 39 and 41 extending from a connecting portion 43. In like manner, the sub-frame 44 may be considered as having a pair of extending arms 45 and 47 connected by a connecting portion 49.

There has thus far been described separately the main frame 10 and the sub-frames 42 and 44. An important feature of the present invention relates to how the sub-frames 42 and 44 are connected to the side frames 12 and 14. The arrangement relating to the ends or four corners of the side frames 12 and 14 are somewhat similar to existing truck side frames with the exception of the addition of shear pad assemblies, such as the assembly 105 illustrated in FIG. 6, which are inserted at the ends thereof.

The corners or ends of the side frames 12 and 14 include openings therein for receiving or mating with projecting sections 82 and 84 connected to the ends of the sub-frame 44 and projections 86 and 88 which are connected to the ends of the arms of the sub-frame 42 (FIG. 7). The projecting sections 82, 84, 86 and 88 are part of the end structures 90, 92, 94 and 96 of the sub-frames. The tops of the main sections 90, 92, 94 and 96 include top projecting portions 98, 100, 102 and 104. These top projections locate the steering arms 42 and 44 within the shear box assemblies contained in the ends of the side frames 12 and 14, one shear box assembly being illustrated in FIG. 6.

A shear pad assembly is disposed at all of the four ends of the side frames 12 and 14. A typical shear pad assembly 105 is connected to the side frame 12. The assembly 105 comprises an upper or outer metal shell 106 and a lower or inner metal shell 107 having an elastomeric member 108, such as rubber, bonded thereto.

The main section 94 of the subframe 44 (FIG. 7) includes a pair of horizontal slide elements 109 and 110. The top projecting section 102 includes a pair of vertical slide elements 111 and 112. The shear pad assemblies permit the longitudinal movements necessary to achieve the desired forced steering. The operation of the shear pad passemblies may be further understood with reference to FIGS. 9 and 10.

Figure 9:
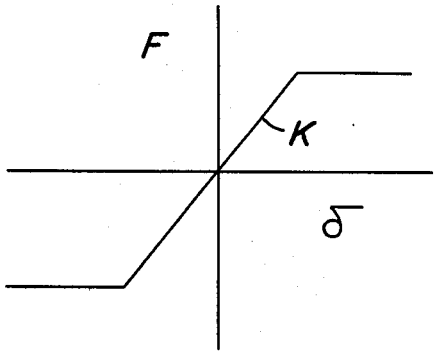
FIG. 9 is a curve illustrating the operation of the shear pads used in the present invention.
Figure 10:
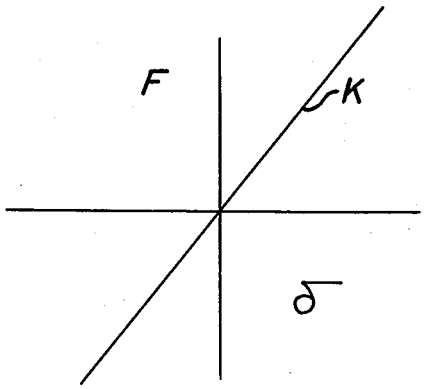
FIG. 10 is a curve shown for purposes of comparing shear pads utilized in the present invention with shear pads of a different design not utilizing the features of the shear pads used in the present invention.

Basically, if the rubber element 108 were used alone without the low friction slide elements, the force vs. deflection characteristic would be that illustrated in FIG. 10. A certain amount of resistance is presented by the rubber element to longitudinal movement. This resistance is much too high to provide adequate forced steering. The addition of the slide elements with the rubber element results in a force versus deflection curve as illustrated in FIG. 9. Initially the shear action of the rubber predominates up to a certain force level. When the force level is exceeded, the action of the friction elements predominate resulting in a fixed level to permit adequate forced steering. Basically, the slide mechanisms are in series with the longitudinal rubber spring element to limit the forces required for steering. Without the low friction elements, the forces required for steering could not be generated in a practical application.

Thus the ends of the sub-frames 42 and 44 are supported by the ends of the side frames 12 and 14. The arrangement including the shear bearing assemblies provides for relative movements between ends of the side frames 12 and 14 and the ends of the sub-frames 42 and 44. These relative movements are necessary to provide the forced steering and to permit the sub-frames 42 and 44 to be moved radially with respect to each other during a forced steering operation.

In addition to supporting the ends of the side frames on the ends of the ends of the sub-frames, the sub-frames 42 and 44 are also connected to the projecting portions 22 and 24 by a pair of vertical hanger members 114 and 116. As illustrated in FIG. 6, the vertical hanger 114 is connected between the sub-frame 42 and the inwardly projecting portion 22 of the main frame. In like manner, the vertical hanger 116 is connected between the sub-frame 44 and the inwardly projecting portion 24 of the main frame. As illustrated in FIG. 1, the projecting portions 22 and 24 are connected to the side frames 12 and 14, respectively. The projecting portions 22 and 24 are held together by a nut and screw arrangement 118 which maintains the two side frames together laterally. FIG. 6 also illustrates car body stops 119 on the bolster 16.

A steering arm or link 120 (FIG. 6) is pivotally and rotatable about a pin 122 on one end and secured to a bracket 124 on its opposite end. The bracket 124 is fixed to the sub-frame 42. The connection to the bracket 124 includes flexible washer members 126 which permit slight angular movement of the steering link 120 within the bracket 124 as would take place during a steering operation. The resilient flexible rings 126 are held in place on the link 120 by conventional nuts and washers.

The pin 122 is fixed within a member 128 which extends from the bolster plate 40. If the car body 18 is going around turns, the bolster 16 will tend to maintain the same relative position as the car. Because of the presence of the steering link or pin 120, the car body will tend to move at an angle with respect to the side frames 12 and 14.

As the railway car goes around turns, the link or pin 120 forces the steering arm 42 to be moved at an angular relationship with respect to the car. The link 120 is adapted to rotate in the pin 122 and about the rubber pads 126.

When the angular position of the sub-frame 42 changes, as illustrated in FIG. 4, the sub-frame 42 will force the sub-frame 44 to also move at an angle as illustrated in FIG. 4. The action of the steering sub-frames 42 and 44 cause the wheels of the wheel/axle assemblies 46 and 48 to move at a slight angle as to maintain radial positions with respect to curved tracks.

As illustrated in FIGS. 4 and 7, when one of the sub-frames 42 or 44 is moved, the other sub-frame must also move. The reason for this is the connections of the arm 76 from the sub-frame 42 and the arm 78 from the sub-frame 44 to the pivot pin 74.

Figure 8A:
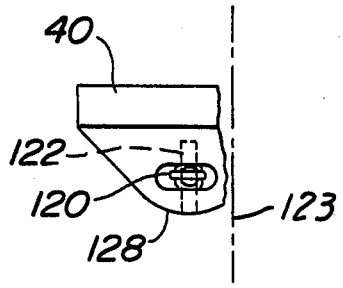
FIGS. 8*a* and 8*b* illustrate a pin for receiving a steering arm connected in different positions with respect to the center line of the pin to permit oversteering or understeering of the wheel-axle assemblies.
Figure 8B:
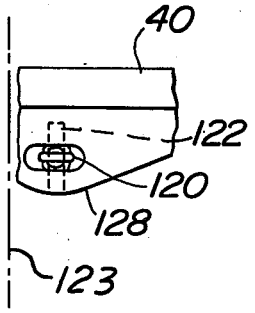

The steering link 120 would normally be positioned on the pin 122 to provide the radial steering for the wheel/axle assemblies 46 and 48. If it is desired to provide oversteering or understeering for reasons mentioned above, the position of the pin and the end of the steering link 120 may be placed more forwardly or rearwardly in a longitudinal direction than that illustrated in FIG. 6. In these events, the pin 122 may be located in different locations to provide oversteering or understeering, if desired. FIG. 5 illustrates the pin 122 as being on the center line 123 of the pin 122. FIG. 8*a* illustrates the pin 122 fixed to member 128 located to the left of the center line 123 to provide oversteering. FIG. 8*b* illustrates the pin 122 located to the right of the pin center line 123 to provide understeering.

The present invention provides an embodiment illustrating that it is mechanically feasible to modify an existing truck arrangement to include a steerable configuration. Many of the conventional members used in cars have been employed including the bolster and side frame arrangements. Also, accommodations are made on the sub-frames to hold the motor gear arrangement and various other parts of the truck.

The present invention has also recognized that it is sometimes desirable to have oversteering or understeering and has provided a relatively simple mechanism which may be changed in location to provide this feature without effecting any of the other parts of the car or truck.

What is claimed is:

1. A forced steerable truck for a railway car body comprising:

(a) a main frame secured to said car body;

(b) said main frame including a pair of side frames and a bolster secured to said side frames;

(c) a pair of "C" shaped steerable sub-frames each having two arm portions extending from a connecting portion;

(d) means for interconnecting the connecting portions of said sub-frames to each other, (e) menas for pivotally connecting said connecting portions of said main frame;

(f) said means for pivotally connecting comprising a vertical hanger member connected between each of said arm portions and said main frame;

(g) a wheel axle assembly secured between each of said two arm portions of sub-frames;

(h) means for connecting the two arm portions of each of said sub-frames to the ends of said side frames;

(i) a steering link member connected between said main frame and one of said steering sub-frames;

(j) said steering link member being adapted to be connected at different locations on said main frame to provide understeering or oversteering;

(k) a vertical pivot member extending from said bolster;

(l) a bracket connected to one of said steering sub-frames; and (m) said steering link member being pivotally mounted to said vertical pivot member at one end and resiliently mounted to said bracket at the other end;

whereby said steering sub-frames are forced to move in accordance with the movement of said car body with respect to said sub-frames.

2. A forced steerable truck as set forth in claim 1 wherein said means for connecting comprises projecting sections at the ends of said arm portions disposed on shear pad assemblies connected to the ends of said side frames.

3. A forced steerable truck as set forth in claim 2 wherein each of said shear pad assemblies comprise an elastomeric member in series with slide pad elements.

4. A forced steerable truck as set forth in claim 3 wherein said main frame includes support members extending inwardly from said side frame to support a bolster center plate.

5. A forced steerable truck as set forth in claim 4 wherein a gear box, motor and braking mechanisms are supported on each of said sub-frames.

6. A forced steerable truck as set forth in claim 5 wherein air springs are disposed on said bolster to support said car body.

* * * * *